US011324250B2

(12) United States Patent
Esposti et al.

(10) Patent No.: US 11,324,250 B2
(45) Date of Patent: May 10, 2022

(54) DEVICE FOR INSPECTING SMOKING ARTICLES

(71) Applicant: G.D S.P.A., Bologna (IT)

(72) Inventors: Marco Esposti, Casalecchio di Reno (IT); Daniele Salvadeo, Monte San Pietro (IT); Ivano Montoleone, Pianoro (IT); Giuliano Gamberini, Crevalcore (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 156 days.

(21) Appl. No.: 16/767,469

(22) PCT Filed: Nov. 28, 2018

(86) PCT No.: PCT/IB2018/059415
§ 371 (c)(1),
(2) Date: May 27, 2020

(87) PCT Pub. No.: WO2019/106569
PCT Pub. Date: Jun. 6, 2019

(65) Prior Publication Data

US 2021/0000163 A1 Jan. 7, 2021

(30) Foreign Application Priority Data

Nov. 30, 2017 (IT) ..... 102017000137830

(51) Int. Cl.
*A24C 5/34* (2006.01)
*A24C 5/32* (2006.01)

(52) U.S. Cl.
CPC ..... *A24C 5/3412* (2013.01); *A24C 5/322* (2013.01)

(58) Field of Classification Search
CPC ..... A24C 5/322; A24C 5/34; A24C 5/3412; B65B 19/30
See application file for complete search history.

(56) References Cited

U.S. PATENT DOCUMENTS 3,237,444 A 3/1966 Heinz et al.
3,914,989 A 10/1975 Reuland et al.
(Continued)

FOREIGN PATENT DOCUMENTS

CN 1671304 A 9/2005
CN 1787752 A 6/2006
(Continued)

OTHER PUBLICATIONS

International Search Report dated Feb. 25, 2019 from counterpart PCT App No. PCT/IB2018/059415.
(Continued)

*Primary Examiner* — Eric Yaary
(74) *Attorney, Agent, or Firm* — Shuttleworth & Ingersoll, PLC; Timothy J. Klima

(57) ABSTRACT

An inspection device for the quality control of rod-shaped smoking articles includes a drum and an inspection assembly. Each transfer drum has a succession of peripheral retaining portions, each having a retaining groove aligned with the axis of rotation of the transfer drum and configured to receive a respective smoking article to be inspected. Each inspection assembly, which is rotatable about the axis of rotation of the transfer drum, is equipped with a succession of detectors. Each detector has a cavity configured to insertably receive an end portion of the respective smoking article to be inspected and is equipped with a sensor adapted to detect an internal structure within the smoking article. The inspection device also comprises a movement device configured to move each peripheral retaining portion and the corresponding detector reciprocatingly towards and away from each other during the rotation of the transfer drum.

13 Claims, 5 Drawing Sheets

(56) References Cited

U.S. PATENT DOCUMENTS

| | | | | |
|---|---|---|---|---|
| 3,930,406 | A | 1/1976 | Pezzi | |
| 2014/0150375 | A1* | 6/2014 | Lena | B65B 19/10 53/54 |

FOREIGN PATENT DOCUMENTS

| | | | |
|---|---|---|---|
| CN | 201488706 | A | 5/2010 |
| CN | 104041937 | A | 9/2014 |
| CN | 104287086 | A | 1/2015 |
| CN | 205333018 | U | 6/2016 |
| CN | 106455677 | A | 2/2017 |
| DE | 102013213936 | A1 | 1/2015 |
| EP | 1623635 | A1 | 2/2006 |
| FR | 2247990 | A1 | 5/1975 |

OTHER PUBLICATIONS

Chinese Office Action dated Aug. 11, 2021 from counterpart Chinese Patent Application No. 201880077506.9.

* cited by examiner

DEVICE FOR INSPECTING SMOKING ARTICLES

This application is the National Phase of International Application PCT/IB2018/059415 filed Nov. 28, 2018 which designated the U.S.

This application claims priority to Italian Patent Application No. 102017000137830 filed Nov. 30, 2017, which application is incorporated by reference herein.

TECHNICAL FIELD

This invention relates to a device for inspecting smoking articles and, in particular, for the quality control of rod-shaped smoking articles, comprising one or more uniform or non-uniform segments of filter and/or tobacco, for example.

In the context of this invention, the term "inspection" is used to denote checking the internal state of the rod-shaped article by causing the entire transverse cross of the article to be traversed by radiation (capacitive, inductive, optical, microwave, X-ray, laser systems).

The term "radiation" implies the use of electrical or electromagnetic energy and excludes tests of a mechanical/pneumatic nature.

BACKGROUND ART

During the production of smoking articles, it is highly advantageous to be able to perform in-process quality control so as to ensure that the product being made is free of defects, extraneous bodies, hollows or other flaws or imperfections which might make it non-marketable once it has been converted into a finished product.

Known in this field are in-process inspection systems capable of checking the quality of a smoking article during its production process.

The Applicant has found, however, that such systems have considerable operational disadvantages which make them very inefficient in the performance of their functions.

In particular, some prior art systems are based on fixed camera detection systems which capture one or more external images of the article.

These systems check only the external surface of the smoking article and, although capable of detecting structural defects and damage to some portions of its exterior, they cannot analyse, or provide any information on, its internal structure.

Also known are pneumatic systems capable of taking measurements of an internal portion of the smoking article. These systems, however, operate by negative air pressure which, when applied to one end of the smoking article, allows checking the smoking article for correct permeability and ventilation properties.

In particular, the air sucked in flows along at least one stretch of the smoking article and exits through the end to which the pneumatic suction unit is applied.

This type of device, however, is not versatile and not very useful for checking other internal properties or inclusions of the smoking article.

DISCLOSURE OF THE INVENTION

In this context, the technical purpose which forms the basis of the present invention is to propose a device for inspecting smoking articles to overcome at least some of the above mentioned disadvantages of the prior art.

More specifically, the aim of this invention is to provide a device for inspecting smoking articles capable of analysing the quality of a smoking article efficiently and non-invasively, such as not to destroy the structural integrity of the smoking articles while it is being analysed.

Another aim of the invention is to provide a device for inspecting smoking articles which is versatile and capable of detecting defects, extraneous bodies, hollows or other flaws or imperfections in the filling of a smoking article independently of the special features of the elements making up the smoking article.

The technical purpose indicated and the aims specified are substantially achieved by a device for inspecting smoking articles comprising the technical features described in one or more of the appended claims.

Accordingly disclosed herein is an inspection device for the quality control of smoking articles comprising at least one transfer drum and at least one inspection assembly.

The transfer drum has a succession of peripheral retaining portions, each of which has at least one retaining groove aligned with the axis of rotation of the transfer drum and is configured to receive a respective smoking article to be inspected.

The inspection assembly is rotatable about the axis of rotation of the transfer drum and is equipped with a succession of detectors.

Each detector has a cavity configured to insertably receive an end portion of the respective smoking article to be inspected and is equipped with a sensor adapted to detect an internal structure within the smoking article.

The inspection device also comprises movement means configured to move each peripheral retaining portion and the corresponding detector reciprocatingly towards and away from each other during the rotation of the transfer drum.

Advantageously, the particular structure of the inspection device according to this invention allows the quality also of the internal structure of the smoking articles to be checked in process, non-invasively and non-destructively.

The dependent claims, which are incorporated herein by reference, correspond to different embodiments of the invention.

BRIEF DESCRIPTION OF THE DRAWINGS

Further features of the invention and its advantages are more apparent in the non-limiting description below, with reference to a preferred but non-exclusive embodiment of a device for inspecting smoking articles, as illustrated in the accompanying drawings, in which.

DETAILED DESCRIPTION OF PREFERRED EMBODIMENTS OF THE INVENTION

Figure 1:
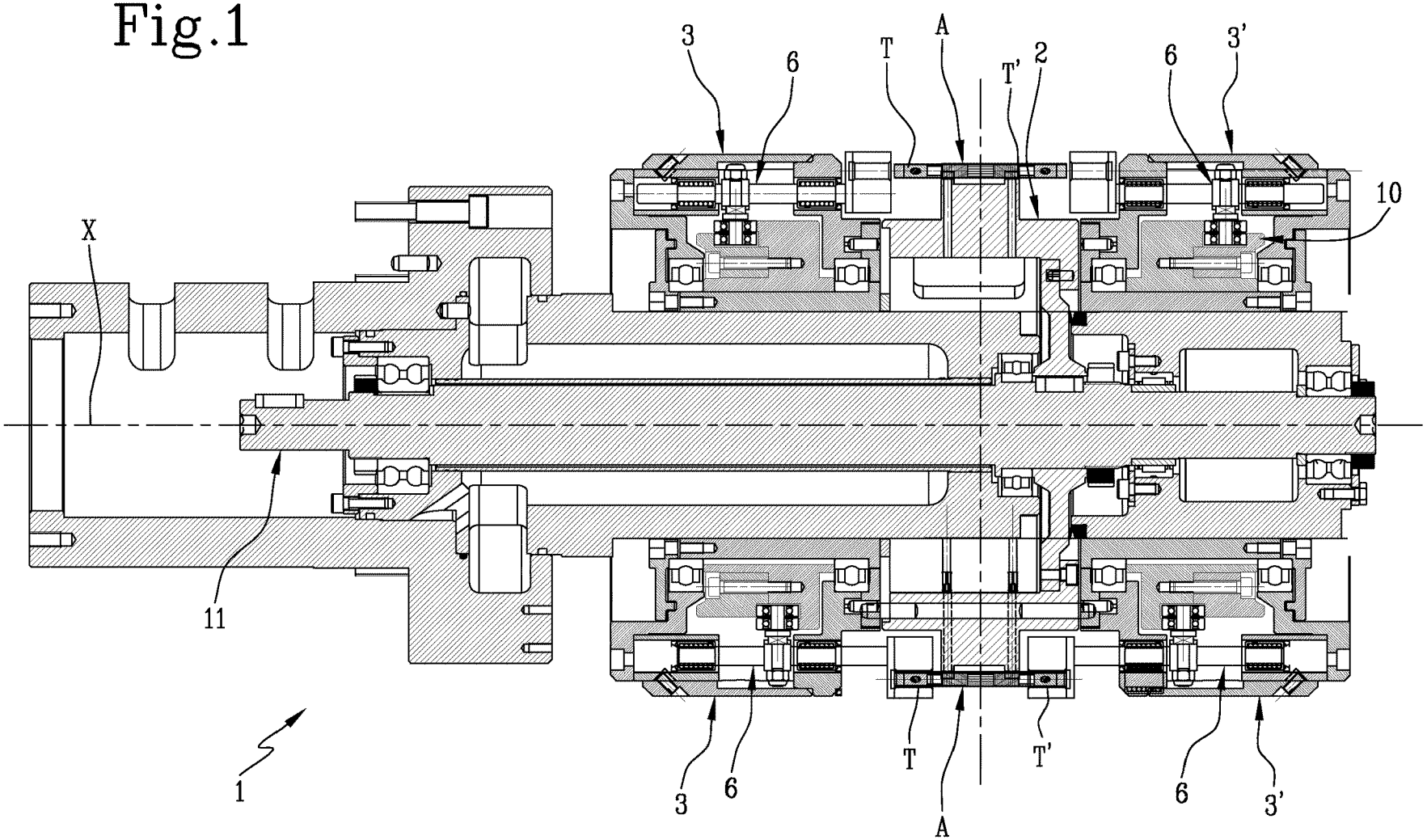
FIG. 1 is a cross-section of the inspection device in accordance with this invention.
Figure 1A:
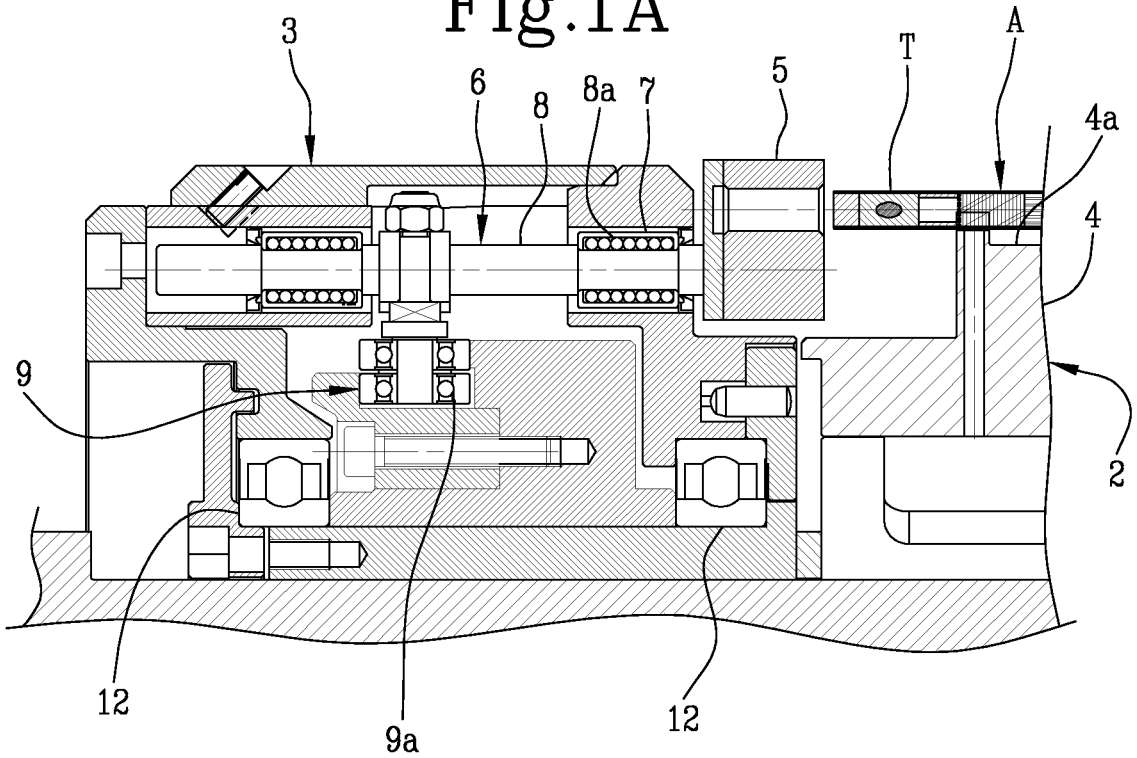
FIGS. 1A-1B are detail views showing some of the components of FIG. 1.
Figure 1B:
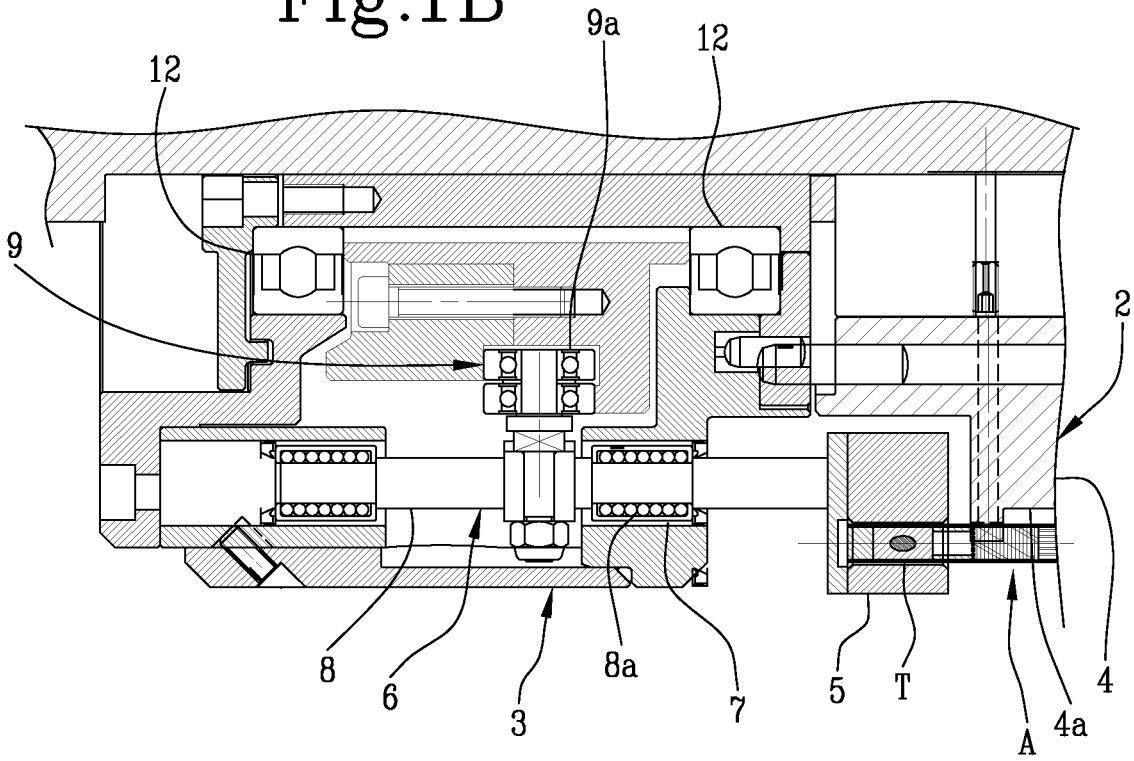

With reference to the accompanying drawings, the numeral 1 denotes in its entirety an inspection device adapted to check the quality of smoking articles "A", in particular rod-shaped smoking articles.

The inspection device 1 comprises at least one transfer drum 2 and at least one inspection assembly 3 rotatable about the axis of rotation "X" of the transfer drum 2.

The transfer drum 2 has a succession of peripheral retaining portions 4, each of which has at least one retaining groove 4*a* aligned with the axis of rotation "X" of the transfer drum and configured to receive a respective smoking article "A" to be inspected.

It should be noted that the adjective "aligned" is used to mean that the axis of each peripheral retaining portion is substantially parallel to the axis of rotation "X" of the transfer drum 2.

In other words, the transfer drum 2 is configured to receive and retain a succession of smoking articles "A" in respective retaining grooves 4*a* disposed radially, preferably equispaced, around the axis of rotation "X" of the transfer drum 2.

More specifically, each retaining groove 4*a* is configured to receive a smoking article "A" from a station of a production line upstream of the inspection device 1 and to hold it, for example with suitable suction means located on the surface of the retaining groove 4*a* itself, at least until the quality control procedure has been completed, and then to release it to a station of the production line downstream of the inspection device 1.

The inspection assembly 3 is provided with a succession of electric or electromagnetic detectors 5 disposed in such a way that each detector 5 is aligned or alignable with a smoking article "A" held in a corresponding retaining groove 4*a*.

In particular, the term "electric or electromegnetic detectors" 5 is used to refer to detectors 5 which are capable of checking the internal state of the article "A" by causing the entire transverse cross of the article "A" to be traversed by radiation (capacitive, inductive, optical, microwave, X-ray, laser systems).

The term "radiation" implies the use of electrical or electromagnetic energy and excludes tests of a mechanical/pneumatic nature. Each detector 5 has a cavity which is configured to insertably receive an end portion "T" of the respective smoking article "A" to be inspected.

Preferably, the end portion to be inspected is a filter, specifically, the filter of a cigarette of single or double size, as shown in the different embodiments of this invention. Preferably, also, the cavity of each detector 5 is deep enough to entirely or almost entirely accommodate the respective filter to be inspected.

More specifically, each detector 5 is equipped with a sensor (sensor emitter unit) adapted to non-destructively detect defects, extraneous bodies, hollows or other imperfections or flaws in the filling of the smoking article "A".

Preferably, each detector 5 comprises at least one of the following: a capacitive sensor, an inductive sensor, an optical sensor, a microwave sensor, an X-ray sensor.

The inspection device 1 also comprises movement means 6 configured to move each peripheral retaining portion 4 and the corresponding detector 5 reciprocatingly towards and away from each other during the rotation of the transfer drum 2.

The movement means 6 allow moving each peripheral retaining portion 4 and/or each respective detector 5 towards or away from each other in such a way that the end portion "T" of the smoking article "A" is inserted into/extracted from the cavity of the detector 5.

The peripheral retaining portions 4 and/or the detectors 5 are also associated with respective straight guides 7 parallel to the axis "X" of the transfer drum 2 and the movement means 6 operate on each peripheral retaining portion 4 and/or on each detector 5 to move them along the respective straight guide 7.

That means each peripheral retaining portion 4 and the corresponding detector 5 move towards and away from each other in a direction parallel to the axis "X" of the drum 2.

Preferably, the detectors 5 are divided into groups in such a way that the detectors 5 of each group are moved simultaneously by the movement means 6, each group still more preferably comprising two detectors 5.

In other words, the detectors 5 are divided into groups, each of which is moved independently of the others; this feature makes it possible to simplify the structure of the at least one inspection assembly 3 and to also reduce the dimensions of the drive components needed to move the detectors 5.

This feature also makes it possible to simplify the structure of the transfer drum 2; in other words, the transfer drum can be made in such a way as to be able to simultaneously move two or more retaining grooves 4*a*.

In effect, each transfer portion 4 may comprise a plurality of retaining grooves 4*a* in such a way that moving a single retaining portion 4 simultaneously moves a plurality of smoking articles "A" held in respective retaining grooves 4*a* of the retaining portion 4.

More specifically, each peripheral retaining portion 4 has at least two retaining grooves 4*a* aligned with the axis of rotation "X" of the transfer drum 2 and configured to receive a respective smoking article "A" to be inspected.

Structurally, the movement means 6 comprise, for each peripheral retaining portion 4 and/or for each detector 5 or group of detectors 5 a drive rod 8 which is slidable in a respective straight guide 7 and a respective cam mechanism 9, preferably housed in a respective inspection assembly 3 acting between the drive rod 8 and a common track defined by a stationary hub 10.

Thanks to this structure, the cam mechanism 9 causes the translational to and fro movement of the drive rod 8 while the transfer drum 2 is rotating.

More specifically, each drive rod 8, which extends parallel to the axis of rotation "X" of the drum 2, is stably connected to one or more cam follower elements (rollers 9*a*) engaged in the aforementioned common track according to a cam coupling method.

The common track extends circumferentially all the way round the axis of rotation "X" of the drum 2 and is non-planar in shape so that at least one part of it is axially offset and each of the rollers 9*a* is moved axially when it reaches the axially offset zone.

To facilitate sliding in the straight guide 7, the part of the drive rod 8 that is coupled to the straight guide 7 comprises a plurality of ball bearings 8*a*, thus defining a rolling guide.

The stationary hub 10 is disposed around the axis of the transfer drum 2 and has inside it an axial cavity within which a transmission shaft 11 is rotatably disposed.

The transmission shaft 11 is rotatable as one with the transfer drum 2 and with the at least one inspection assembly 3.

In other words, the transfer drum 2 and each inspection assembly 3 are attached to the transmission shaft 11 in such a way as to be driven in rotation about the axis "X" of the transfer drum 2 when the transmission shaft 11 rotates.

The stationary hub 10, on the other hand, is fixed, that is to say, non-rotational, even and especially during the rotation of the transmission shaft 11, so as to define a fixed common track for the cam mechanism 9 in which the rollers 9*a* can slide in such a way as to produce the aforementioned to and fro translational movement.

Structurally, the stationary hub 10 and the transmission shaft 11 are therefore rotationally uncoupled by means of a plurality of bearings 12 interposed between them, allowing the transmission shaft 11 to rotate while the stationary hub 10 remains fixed.

Generally speaking, therefore, the movement means 6, which are activated when the transmission shaft 11 rotates, are configured to move each peripheral retaining portion 4 and/or each detector 5 or group of detectors 5 between a pickup/release position where the peripheral retaining portion 4 is distal from each detector 5 so as to be able to pick up/release a smoking article "A"—for example, from/to a processing station situated upstream/downstream of the inspection device 1, and a detection position where the peripheral retaining portion 4 is proximal to at least one detector 5 so that the smoking article "A" in that supporting portion 4 is at least partly inserted in the cavity of the detector 5.

Advantageously, the inspection device 1 may also comprise a control unit "C" configured to receive a signal generated by the sensor of a detector 5 when the end portion "T" of a smoking article "A" is inserted into the cavity thereof.

In other words, when the end portion "T" is inside the cavity, the sensor takes a measurement containing data regarding the internal composition of the end portion "T" and transmits the data collected to the control unit "C".

The control unit "C" may in turn either perform an initial analysis of the signal received to assess the quality of the smoking article "A" to determine whether or not it meets a plurality of predetermined quality parameters, or it may re-transmit the data collected to a further processing unit configured to process and analyse the data.

This transmission of data from the control unit "C" to the fixed processing unit is accomplished by at least one rotary, signal transmission coupling "S" (or slip ring) mounted coaxially with the shaft 11.

Advantageously, this and/or another rotary coupling "S" also allows at least one detector 5 to be electrically powered.

In a first embodiment of the invention, shown in detail in FIG. 1, the inspection device 1 comprises two inspection assemblies 3, 3' axially spaced along the axis of rotation "X" of the transfer drum 2 to operate on opposite ends "T", "T" of the smoking articles "A" held in the retaining grooves 4*a*.

In other words, the inspection device 1 is provided with two inspection assemblies 3, 3' disposed to face each other on opposite sides of the transfer drum 2 so that the peripheral retaining portions 4 are interposed between each pair of detectors 5 belonging to respective inspection assemblies 3, 3'.

Thanks to this structure, when a smoking article "A" is held in a respective retaining groove 4*a*, there are always two detectors 5 which are aligned or alignable with that retaining groove 4*a* on opposite sides of the retaining groove 4*a*, so as to allow inserting a first end portion "T" into the respective detector 5 of the first inspection assembly 3 and a second end portion "T" into the respective detector 5 of the second inspection assembly 3'.

Also in this embodiment, the movement means 6 operate on each detector 5 to move it towards and away from a respective peripheral retaining portion 4 during the rotation of the transfer drum 2, the peripheral retaining portion 4 being preferably axially stationary during the rotation of the transfer drum 2.

More specifically, during the rotation of the inspection device 1, the transmission shaft 11 drives the transfer drum 2 and the two inspection assemblies 3, 3' simultaneously in rotation.

The movement means 6 are associated with each detector 5 of the inspection assemblies 3, 3' and the related cam mechanisms 9 slide in the path that is delimited by the common track defined by the stationary hub 10, so as to move the detectors 5 towards/away from the transfer drum 2.

More specifically, the movement towards causes the end portions "T", "T" of a smoking article "A" held in a retaining groove 4*a* of the transfer drum 2 to be inserted into the cavities of respective facing sensors 5 belonging to two inspection assemblies 3, 3' so that both the end portions "T", "T" of the smoking article "A" can be inspected simultaneously.

More specifically, it is preferable for the two detectors 5 associated with each peripheral retaining portion 4 to be moved simultaneously towards and away from the peripheral retaining portion 4 so that inspection is performed simultaneously.

Figure 2:
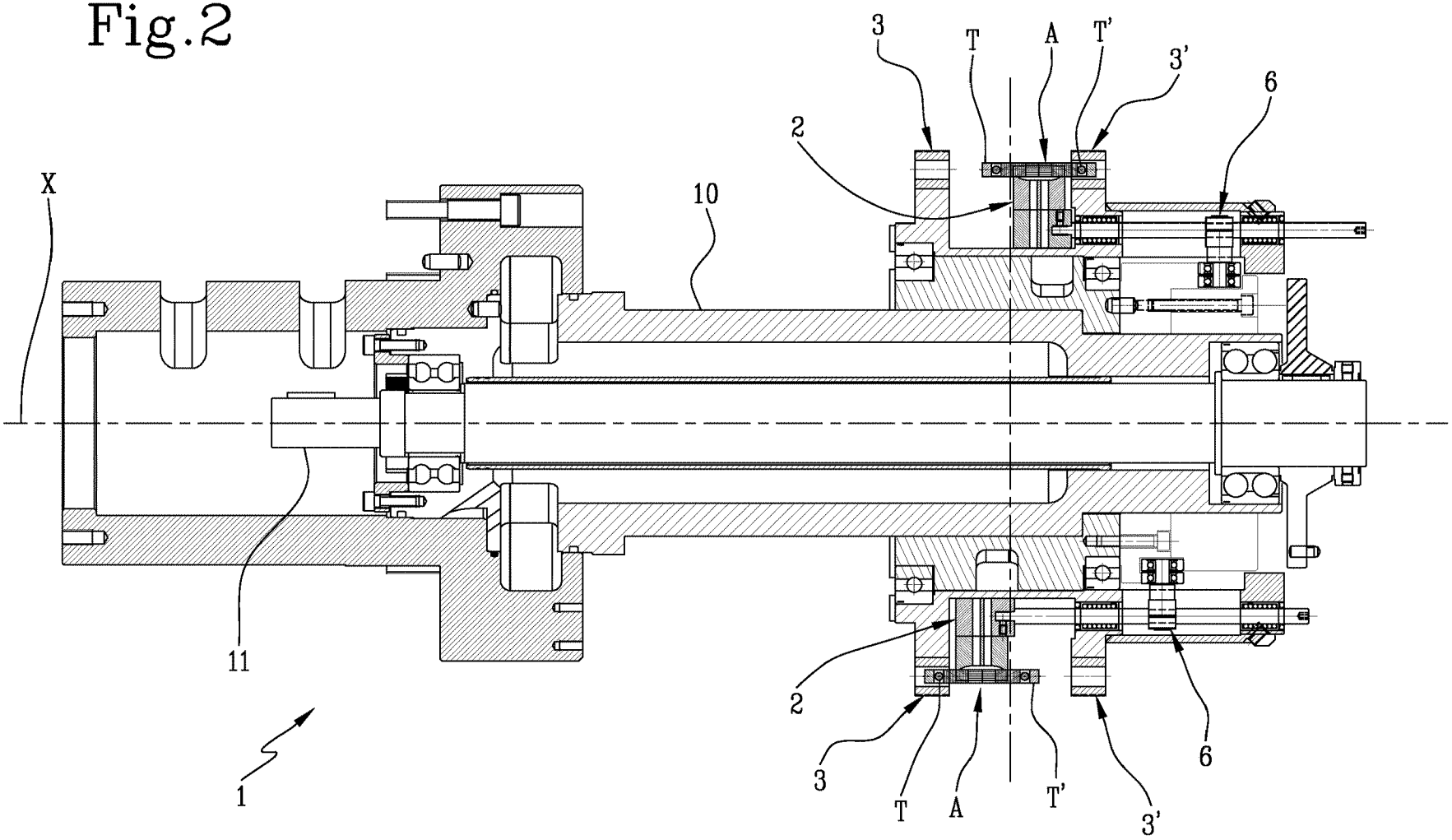
FIG. 2 is a cross section of a further possible embodiment of the inspection device.
Figure 3:
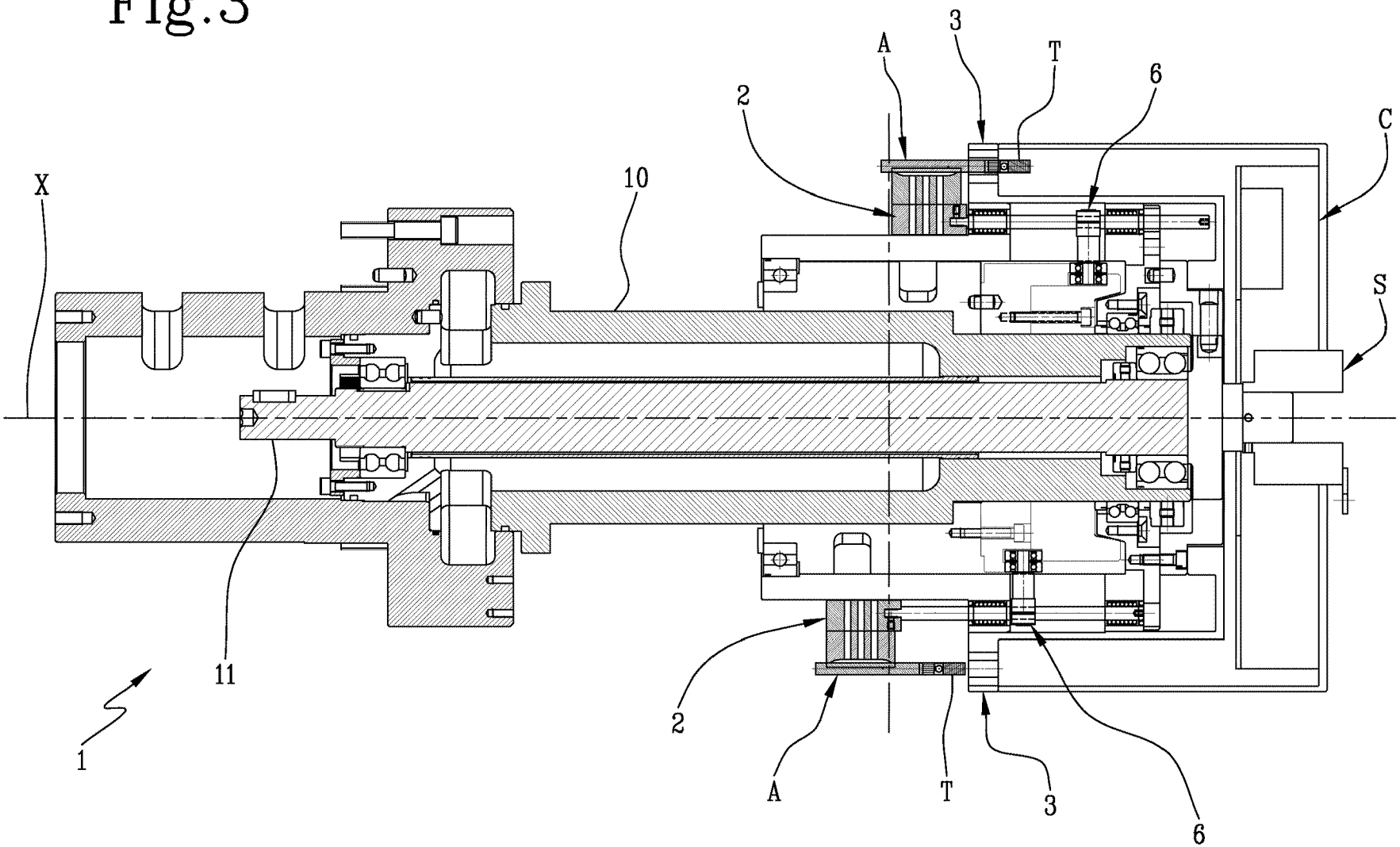
FIG. 3 is a cross section of a further possible embodiment of the inspection device.

Alternatively, in embodiments illustrated in more detail in FIGS. 2 and 3, the movement means 6 operate on each peripheral retaining portion 4 to move it towards and away from a respective detector 5 during the rotation of the transfer drum 2, each detector 5 in such an embodiment being preferably axially stationary during the rotation of the transfer drum 2.

More specifically, in the embodiment illustrated in more detail in FIG. 2, the inspection device comprises two inspection assemblies 3, 3' which are axially fixed and a transfer drum 2 whose peripheral retaining portions 4 are, instead, axially movable.

The movement means 6 are associated with each peripheral retaining portion 4 of the transfer drum 2 in such a way as to move them axially, causing sequential insertion of each end "T", "T" of a smoking article "A" held in a respective retaining groove 4*a* first into the cavity of a sensor 5 of the first inspection assembly 3 and then into the cavity of a sensor 5 of the second inspection assembly 3'.

In the specific case where only one end portion "T" of the smoking article "A" needs to be inspected, as shown in more detail in FIG. 3, the inspection device may comprise only one axially fixed inspection assembly 3, aligned or alignable with the end portion "T" of the smoking article "A" to be inspected.

According to this embodiment, the movement means 6 cause each peripheral retaining portion 4 to be moved closer to a respective sensor 5, thus inserting the end portion "T" to be inspected into the cavity of the sensor 5.

Once the measurement has been taken, the movement means 6 cause each peripheral retaining portion 4 to be moved away from a respective sensor 5, thus extracting the inspected end portion "T" from the cavity of the sensor 5.

Thus, with reference to a use configuration applicable in general to the embodiments described up to here, the inspection device is configured to receive at least one smoking article "A" from the transfer drum 2 and more precisely, from a retaining groove 4*a*.

Next, the movement means 6 move the peripheral retaining portion 4, provided with the retaining groove 4*a* which holds the smoking article "A", and the detector 5 aligned therewith towards each other during the rotation of the transfer drum 2 in such a way that the end portion "T" of the smoking article "A" is inserted into the cavity of the detector 5.

This relative movement may be obtained either by moving each peripheral retaining portion 4 relative to a respective, axially fixed detector 5 or by moving each detector 5 relative to a respective, axially fixed peripheral retaining portion 4.

At this point, the sensor of the detector 5 analyses the internal structure of the end portion "T" of the smoking article "A" in such a way as to non-destructively detect defects, extraneous bodies, hollows or other imperfections or flaws in the filling of the smoking article "A".

The information received from the sensor, whether it is processed directly by a control unit "C" mounted on board the inspection device 1 or used by an external processing unit, allows deciding whether the smoking article "A" meets one or more predetermined quality parameters and is thus suitable for marketing or must, instead, be rejected because it does not meet these quality parameters.

The quality parameters may be selected from at least one of the following: presence and/or integrity of additional elements inside the filter, filling factor (absence of hollows), density, humidity or others.

After that, the movement means 6 move the peripheral retaining portion 4, provided with the retaining groove 4*a* which holds the smoking article "A", and the detector 5 aligned therewith away from each other in such a way that the end portion "T" of the smoking article "A" is extracted from the cavity of the detector 5.

At this point, the smoking article "A" can be transferred from the transfer drum 2 to a subsequent processing station, situated downstream of the inspection device 1, where, depending on the outcome of the measurement taken by the detector 5, it will be rejected or will proceed in the production process to become part of a marketable finished product.

Figure 4:
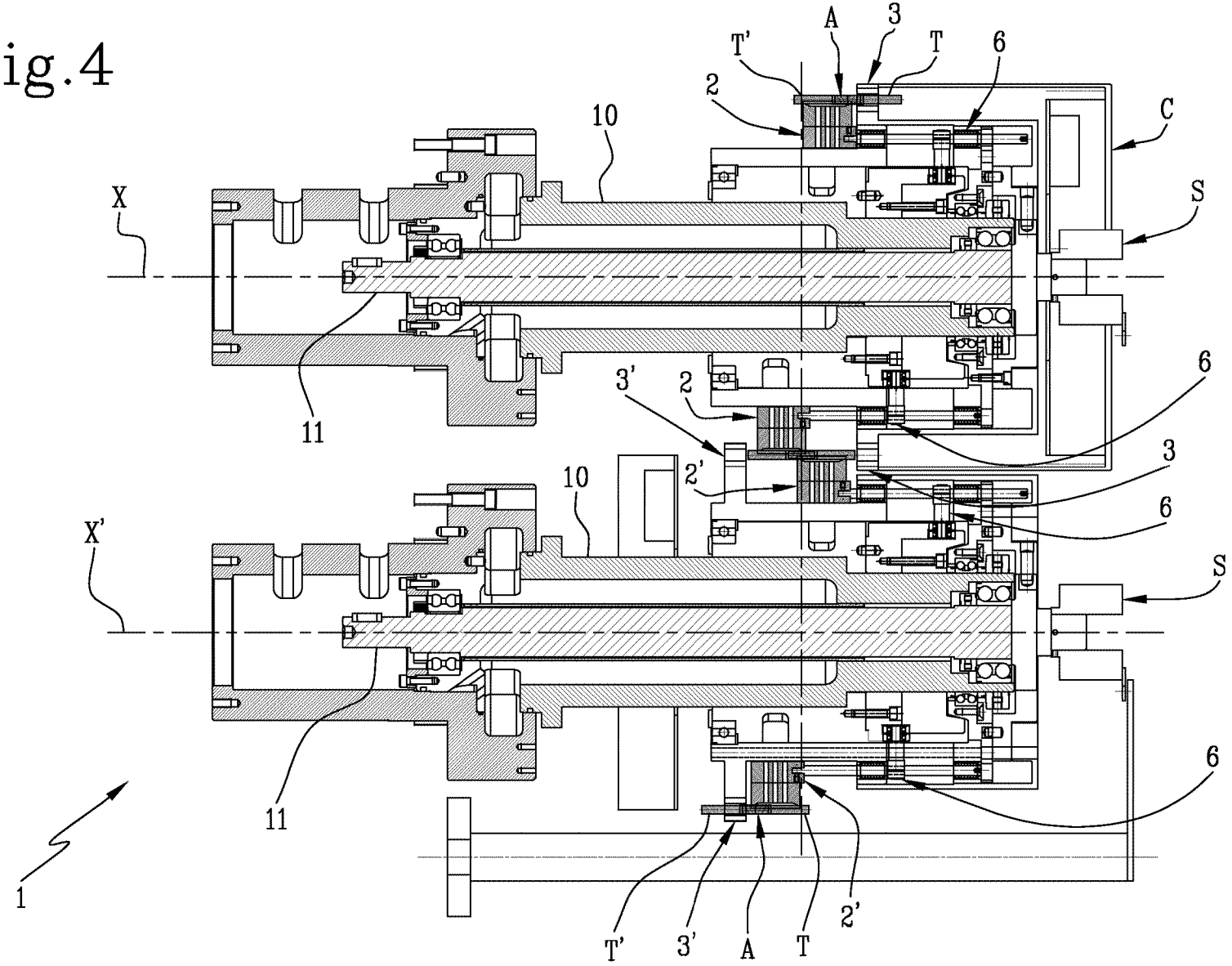
FIG. 4 is a cross section of a further possible embodiment of the inspection device.

FIG. 4, on the other hand, shows a possible alternative embodiment which comprises two transfer drums 2, 2' and two inspection assemblies 3, 3'.

More specifically, in this embodiment, the inspection device 1 comprises a first and a second transfer drum 2, 2' associated with a first and a second inspection assembly 3, 3', respectively.

The transfer drums 2, 2' each have a succession of peripheral retaining portions 4, each of which has at least one retaining groove 4*a* aligned with the axis of rotation "X", "X'" of the respective transfer drum 2, 2' it belongs to and configured to receive a respective smoking article "A" to be inspected.

The inspection assemblies 3, 3' are rotatable about the axis of rotation "X", "X'" of the respective transfer drum 2, 2' and are each provided with a succession of detectors 5 disposed in such a way that each detector 5, 5' is aligned or alignable with a smoking article "A" held in a corresponding retaining groove 4 of the respective transfer drum 2, 2'.

Each detector 5 has a cavity configured to insertably receive an end portion "T" of the respective smoking article "A" to be inspected and is equipped with a sensor adapted to non-destructively detect defects, extraneous bodies, hollows or other flaws or imperfections in the filling of the smoking article "A".

Furthermore, the first and second drums 2, 2' are substantially tangent to each other in order to transfer a succession of smoking articles "A" from the retaining grooves 4 of the first transfer drum 2 to the retaining grooves 4 of the second transfer drum 2'.

More specifically, the first and second inspection assemblies 3, 3' are disposed in such a way as to inspect opposite ends of the smoking articles (A) held in the peripheral retaining grooves 4.

To enable it to move and function correctly, the inspection device 1 also comprises, for each transfer drum 2, 2', respective movement means 6 configured to move each peripheral retaining portion 4 and the corresponding detectors 5 aligned or alignable therewith reciprocatingly towards and away from each other during the rotation of the transfer drums 2, 2'.

More specifically, the movement means 6 operate on the peripheral retaining portions 4 to axially move them relative to the respective inspection assemblies 3, 3', which are preferably axially stationary during the rotation of the respective transfer drum 3, 3'.

More in detail, in use, the first transfer drum 2 receives in one of its retaining grooves 4*a* a smoking article "A" from a processing station situated upstream of the inspection device.

The movement means 6 associated with the peripheral retaining portion 4 provided with the retaining groove 4*a* holding that smoking article "A" start moving the peripheral retaining portion 4 towards the first inspection assembly 3, causing the first end portion "T" of the smoking article "A" to be inserted into the cavity of a respective sensor 5 belonging to the first inspection assembly 3.

At this point, it is thus possible to inspect the first end portion "T" of the smoking article "A".

A subsequent movement of the peripheral retaining portion 4 away from the first inspection assembly 3 causes the first end portion "T" of the smoking article "A" to be extracted from the cavity of the sensor 5, bringing the peripheral retaining portion back to the pickup/release position.

The smoking article "A" is then transferred from the first transfer drum 2 to the second transfer drum 2', thus passing into another retaining groove 4*a*, which is also at the pickup/release position.

Next, the movement means 6 of the second transfer drum 2' move the peripheral retaining portion 4 which is provided with the retaining groove 4*a* holding the smoking article "A" to be inspected and bring that peripheral retaining portion 4 to the inspection position: that is to say, cause it to move towards the second inspection assembly 3'.

That way, the second end portion "T" of the smoking article "A" is inserted into the cavity of a respective sensor 5 belonging to the second inspection assembly 3'.

Once inspection of the internal structure of the second end potion "T" of the smoking article "A" has been completed, the movement means 6 move the peripheral retaining portion 4 away from the second inspection assembly 3', causing the second end portion "T" of the smoking article "A" to be extracted from the cavity of the sensor 5, bringing the peripheral retaining portion 4 back to the pickup/release position.

When the inspection procedure is over, the inspected smoking article "A" can be released to a processing station situated downstream of the inspection device 1.

In order to optimize the inspection process and improve the efficiency of the transfer process, each smoking article "A" is greater in length than the retaining grooves 4 and is held in a respective retaining groove 4*a* of the first transfer drum 2 at a first end portion "T" of the smoking article "A" opposite to the first inspection assembly 3.

In the same way, the smoking article "A" is held in a respective retaining groove 4*a* of the second transfer drum 2' at a second end portion "T" of the smoking article "A" opposite to the first end portion "T" and to the second inspection assembly 3'.

Advantageously, the inspection device 1 according to this invention allows the quality of the internal structure of a smoking article "A" to be checked non-invasively and non-destructively.

Moreover, thanks to the wide range of inspections that can be carried out, the device is versatile and applicable to the inspection of several parameters and/or properties of the smoking articles.

The invention claimed is:

1. An inspection device for quality control of rod-shaped smoking articles, comprising:

at least one transfer drum having a succession of peripheral retaining portions, each peripheral retaining portion having at least one retaining groove aligned with an axis of rotation of the at least one transfer drum and configured to receive a respective smoking article to be inspected;

at least one inspection assembly rotatable about the axis of rotation of the at least one transfer drum and provided with a succession of electric or electromagnetic detectors disposed in such a way that each detector is aligned or alignable with a smoking article held in a corresponding retaining groove, each detector having a cavity configured to insertably receive an end portion of the respective smoking article to be inspected and being equipped with a sensor adapted to non-destructively detect defects, extraneous bodies, hollows or other imperfections or flaws in the filling of the respective smoking article, movement means configured to move each peripheral retaining portion and the corresponding detector reciprocatingly towards and away from each other during the rotation of the at least one transfer drum.

2. The device according to claim 1, wherein the peripheral retaining portions and/or the detectors are associated with respective straight guides parallel to the axis of the at least one transfer drum and wherein the movement means operate on each peripheral retaining portion and/or on each detector to move the peripheral retaining portion and/or the detector along the respective straight guide.

3. The device according to claim 1, wherein the detectors of each of the at least one inspection assembly are divided into groups in such a way that the detectors of each group are moved simultaneously by the movement means, each group comprising two detectors.

4. The device according to claim 3, wherein the movement means comprise, for each peripheral retaining portion and/or for each detector or group of detectors, a drive rod which is slidable in a respective straight guide and a respective cam mechanism acting between the drive rod and a common track defined by a stationary hub in such a way that during the rotation of the at least one transfer drum, the cam mechanism causes a to-and-fro translational movement of the drive rod.

5. The device according to claim 4, wherein the stationary hub is disposed around the axis of the at least one transfer drum and has internally an axial cavity within which a transmission shaft is rotatably disposed, the transmission shaft being rotatably connected to the peripheral retaining portions and to the at least one inspection assembly.

6. The device according to claim 1, wherein each detector comprises at least one of the following: a capacitive sensor, an inductive sensor, an optical sensor, a microwave sensor, an X-ray sensor.

7. The device according to claim 1, wherein the at least one inspection assembly comprises two inspection assemblies axially spaced along the axis of rotation of the at least one transfer drum to operate on opposite ends of the smoking articles held in the retaining grooves of the peripheral retaining portions.

8. The device according to claim 1, wherein the movement means operate on each detector to move the detector towards and away from a respective peripheral retaining portion during the rotation of the at least one transfer drum, the peripheral retaining portion being preferably axially stationary during the rotation of the at least one transfer drum.

9. The device according to claim 1, wherein the movement means operate on each peripheral retaining portion to move the peripheral retaining portion towards and away from a respective detector during the rotation of the at least one transfer drum, the detector being preferably axially stationary during the rotation of the at least one transfer drum.

10. The device according to claim 1, wherein the movement means are configured to move each peripheral retaining portion and/or each detector between a pickup/release position where the peripheral retaining portion is distal from each detector so as to be able to pick up/release a smoking article, and an inspection position where the peripheral retaining portion is proximal to a detector so that the smoking article in that peripheral retaining portion is at least partly inserted in the cavity of the detector.

11. The device according to claim 1, comprising:

wherein the at least one transfer drum includes a first transfer drum and a second transfer drum;

wherein the at least one inspection assembly inicludes a first inspection assembly and a second inspection assembly;

the first transfer drum having a succession of the peripheral retaining portions, each peripheral retaining portion having at least one of the at least one retaining groove aligned with the axis of rotation of the first transfer drum and configured to receive the respective smoking article to be inspected;

the first inspection assembly rotatable about the axis of rotation of the first transfer drum and provided with a succession of the detectors disposed in such a way that each detector is aligned or alignable with the respective smoking article held in the corresponding retaining groove of the first transfer drum, each detector having a cavity configured to insertably receive a first end portion of the respective smoking article to be inspected and being equipped with the sensor adapted to non-destructively detect defects, extraneous bodies, hollows or other imperfections or flaws in the filling of the respective smoking article;

the second transfer drum having a succession of the peripheral retaining portions, each peripheral retaining portion having at least one of the at least one retaining groove aligned with the axis of rotation of the second transfer drum and configured to receive the respective smoking article to be inspected;

the second inspection assembly rotatable about the axis of rotation of the second transfer drum and provided with a succession of the detectors disposed in such a way that each detector is aligned or alignable with the respective smoking article held in the corresponding retaining groove of the second transfer drum, each detector having a cavity configured to insertably receive a second end portion of the respective smoking article to be inspected and being equipped with the sensor adapted to non-destructively detect defects, extraneous bodies, hollows or other imperfections or flaws in the filling of the respective smoking article;

wherein the first and second transfer drums are substantially tangent to each other in order to transfer a succession of the smoking articles from the retaining grooves of the first transfer drum to the retaining grooves of the second transfer drum, wherein the first and second inspection assemblies are disposed in such a way as to inspect opposite ends of the smoking articles held in the retaining grooves, and for each of the first and second transfer drums or each first and second inspection assemblies, a respective one of the movement means configured to move each peripheral retaining portion and the corresponding detector reciprocatingly towards and away from each other during the rotation of the first/second transfer drum.

12. The device according to claim 11, wherein the movement means operate on the peripheral retaining portions to axially move the peripheral retaining portions relative to the respective first and second inspection assemblies, the first and second inspection assemblies being axially stationary during the rotation of the respective one of the first and second transfer drums.

13. The device according to claim 11, wherein each respective smoking article is greater in length than the retaining grooves and is held in the corresponding retaining groove of the first transfer drum at a first end portion of the smoking article opposite to the first inspection assembly, and is held in the corresponding retaining groove of the second transfer drum at a second end portion of the smoking article opposite to the first end portion and to the second inspection assembly.

* * * * *